US006131215A

United States Patent [19]

Lindell

[11] Patent Number: 6,131,215

[45] Date of Patent: Oct. 17, 2000

[54] DEVICES FOR MOVING PATIENTS AND METHOD

[76] Inventor: Tom Lindell, Mariehamnsgaian 22, S-164 79 Kista, Sweden

[21] Appl. No.: 09/254,370

[22] PCT Filed: May 23, 1997

[86] PCT No.: PCT/SE97/00852

§ 371 Date: Apr. 26, 1999

§ 102(e) Date: Apr. 26, 1999

[87] PCT Pub. No.: WO98/08477

PCT Pub. Date: Mar. 5, 1998

[30] Foreign Application Priority Data

Aug. 29, 1996 [SE] Sweden ..... 96009576

[51] Int. Cl.[7] ..... A61G 7/10; A61G 1/02

[52] U.S. Cl. ..... 5/86.1; 5/81.1 HS; 5/610; 5/618

[58] Field of Search ..... 5/86.1, 83.1, 81.1 R, 5/81.1 HS, 610, 618

[56] References Cited

U.S. PATENT DOCUMENTS

| | | | |
|---|---|---|---|
| 2,234,483 | 3/1941 | Sutton | 5/86.1 |
| 2,542,963 | 2/1951 | Knox et al. | 5/86.1 |
| 2,984,843 | 5/1961 | Johnson | 5/86.1 |
| 3,284,816 | 11/1966 | Laubsch . | |
| 4,028,752 | 6/1977 | Oerthel | 5/86.1 |
| 5,121,514 | 6/1992 | Rosane | 5/628 |
| 5,329,655 | 7/1994 | Garner | 5/502 |

FOREIGN PATENT DOCUMENTS

| | | |
|---|---|---|
| 3619837 | 12/1987 | Germany . |
| 2294883 | 5/1996 | United Kingdom . |

*Primary Examiner*—Alexander Grosz
*Attorney, Agent, or Firm*—Young & Thompson

[57] ABSTRACT

A roll coach for moving patients to and from a hospital bed is disclosed. It comprises a frame (4, 6, 8) a movable bunk (30) mounted on said frame (4, 6, 8), a lifting mechanism (14, 18, 20, 22, 24) connecting the bunk (30) with the frame and operative to move the bunk in a vertical direction, and a tilting mechanism (28, 32, 34) operative to tilt the bunk (30) such as to bring the side of the bunk in contact with the bed surface essentially in the middle of the bed. There is also disclosed a drag sheet and a method of moving a patient to and from a hospital bed by using a moveable bunk.

15 Claims, 9 Drawing Sheets

DEVICES FOR MOVING PATIENTS AND METHOD

The present invention relates in general to methods and devices for moving non-ambulatory patients to and from hospital beds.

In particular it relates to a roll coach having a tiltable bunk for safe transfer of a patient from a bed to said bunk and back again, after the patient having been subjected to various treatments, such as surgery, therapy, hygienic care, toilet etc.

BACKGROUND OF THE INVENTION

For the purposes of the present application the term "bunk" means a resting surface that is not a proper bed, but which is suitable for temporary placement of a patient for transport or treatment purposes.

In the medical care of non-ambulatory patients, the process of moving a patient from a bed and to another means for transport, basically involves the use of two different methods: moving by lifting, or moving by dragging the patient off the bed.

For lifting purposes it is required to install electrical lifting means, commonly mounted in the ceiling, or a portable lifting carriage, and a lifting or hoisting sling. This method would often require two medical staff, and it can be very trying for both the staff and for the patient, especially if the patient only may be moved in a horizontal position, such as when there is a spinal injury or other internal damage requiring careful handling of the patient.

When the patient is to be dragged off the bed and onto a temporary bunk or roll coach, the patient must be moved from the center of the bed to the edge of the bed before the transfer to the bunk may be made. Often there is present a small gap or space between the mattress of the bed and the roll coach. This gap may cause problems in the transfer from bed to bunk.

Frequently it is required to move the patient from the bed to a wheel-chair. This requires that the patient be moved to the side of the bed, the legs must be brought over the edge, and the patient must be raised to a sitting position. Thereafter a sideways movement must take place, possibly by use of a special gliding plate, temporarily provided between the bed and the wheel-chair.

In order to facilitate the sideways movement to the edge of the bed, there has recently been introduced glide mats, which consist of a sheet of fabric having two opposite edges attached to each other so as to form a tube like configuration having a low friction interior surface. The tubelike glide mat is placed slightly underneath the patient in a flat configuration, and when the patient is dragged carefully to the side, the upper side of the glide mat will form a sheet gliding on the lower portion, by virtue of its low friction interior surface.

When the patient is to be replaced in the bed from the bunk after having been treated, it may be very difficult and sometimes impossible to push the patient back onto the bed. The gap mentioned above may cause problems and discomfort also in this case. Finally, the patient will end up on the edge of the bed after having been transferred from the bunk, and must be pushed further towards the middle of the bed, in order to take a comfortable position in the bed. Of course the use of a glide mat will facilitate also the placing of the patient onto the bed.

A requirement in the care of non-ambulatory patients is that they must be allowed to stand up at least once a day during 15–20 minutes. Unless this therapy is carried out, the patient will suffer complications in terms of i.a. decalcification of the skeleton, heart insufficiency, muscle atrophy, problems with the peristalsis, and balance problems.

Normally the procedure used today for the kind of therapy outlined above is to move the patient from the bed to a wheelchair in order to transport the patient to the location in the hospital where therapy equipment is available.

The patient is then transferred from the wheel-chair onto a special tiltable bunk or coach, where the patient may be raised to an upright position, while still resting against the bunk.

After the therapy the patient must again be transferred to the wheel-chair, transported back to the ward, where he/she finally is transferred onto the bed. Thus, this simple therapy requires a substantial amount of work and inconvenience for the staff and patient.

In U.S. Pat. No. 4,028,752 there is disclosed an apparatus for lifting, arranging and/or transporting non-ambulatory patients. It includes a mobile support and an elongated element mounted thereon, to serve as a temporary bunk for a patient to be moved. The operation of the apparatus according to this patent is very similar to a fork-lift device. It provides three different movements, raising, lowering and tilting. By tilting the frame on which the bunk is mounted, the bunk is positioned alongside of a patient, who is then placed on the bunk.

In practical use of this kind of equipment a problem is that the bunk will not be inserted underneath the patient, instead the bunk pushes the patient sideways. Also, a dragging action is required in order to bring the patient onto the bunk.

In DE-36 19 837 there is disclosed a lifting device for non-ambulatory patients. It comprises a carrying frame with a conveyor belt system that is intended to engage on the patient's body, and to pull it onto the carrying frame. The frame is tiltable and may be raised or lowered. The device according to this disclosure is extremely complex, and therefore expensive to manufacture.

SUMMARY OF THE INVENTION

The present invention therefore sets out to provide a method and devices for easy and comfortable transfer of patients to and from hospital beds, without strain to medical staff or patients, wherein the drawbacks of the prior art devices are overcome. The bunk itself may be used for the necessary therapy, as outlined above, which can thus be performed in the ward.

The device according to the invention generally comprises a low frame provided with a lifting means to which a thin bunk is connected such that it may be tilted sideways around a horizontal axis, parallel to the bunk. The angular settings are made by means of linear actuators.

Thus, means are provided for bringing the patient lying on the bunk in and over the center of the bed, and thereafter the bunk is tilted slowly sideways towards the bed surface. The patient then slides down onto the bed, whereafter the bunk is pulled back. The patient is now located essentially in the center of the bed and need not be moved further.

The tilting is performed such that the transverse position of the bunk does not change during tilting, thereby insuring that the patient will be properly located once he/she has been finally transferred onto the bed.

Further scope of applicability of the present invention will become apparent from the detailed description given hereinafter. However, it should be understood that the detailed description and specific examples, while indicating preferred embodiments of the invention, are given by way of illustration only The present invention will become more fully understood from the detailed description given hereinbelow.

DESCRIPTION OF PREFERRED EMBODIMENTS

Figure 1:
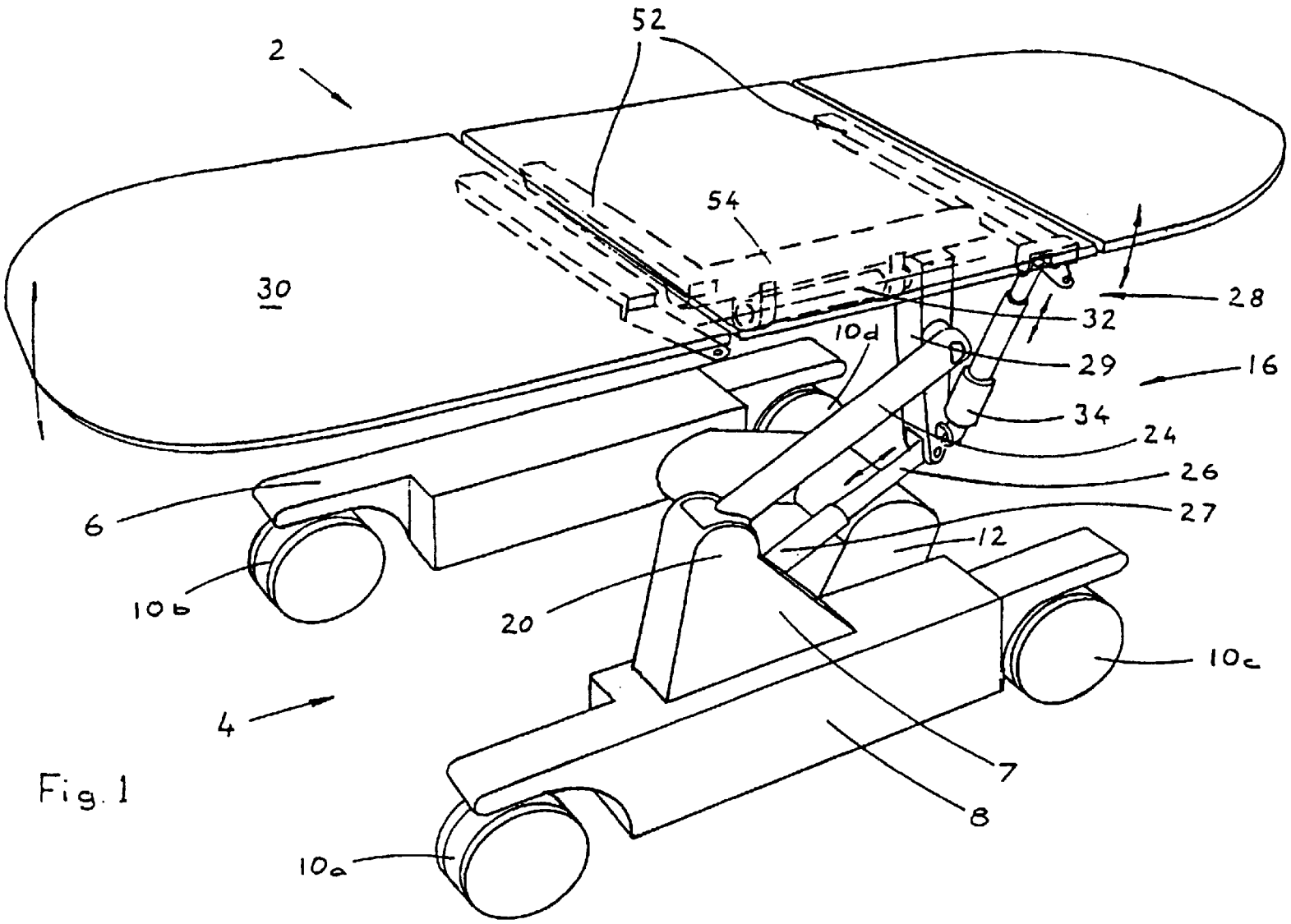
FIG. 1 is a perspective view of a roll bunk according to the invention.

A first embodiment of the tiltable bunk device according to the invention is illustrated in FIG. 1, and designated generally with the reference numeral 2.

It comprises a frame 4 comprising two elongated box structures 6, 8 provided with a swivel castor 10*a–d* in each end thereof. The boxes 6, 8 are connected to each other via an essentially U-shaped element 12 made of metal tube. Said element 12 houses electrical cabling for energizing the various actuators. The width of the frame is sufficient to insure that it will render the entire device stable enough not to turn over. One box 6 contains batteries and relays. The other box 8 contains a linear actuator 14 (not shown in FIG. 1), used for the lifting mechanism of the bunk.

In general the linear actuators used in the invention are based on a rotating screw, energized by an electrical motor. The screw runs in a nut that is secured in a pivotal member in such a way that the screw pulls or pushes said member when it rotates in the nut. However, it is of course conceivable to use other types of actuator, such as hydraulic cylinders to achieve the same function.

The bunk further comprises a lifting device, generally designated 16. Said lifting device comprises a linear actuator 14 connected to a lever 18 (see FIG. 4), a bearing 20, a bearing housing 22, a lifting arm 24, a parallel rod 26 comprising a linear actuator 27, and a lifting yoke 28.

Figure 4:
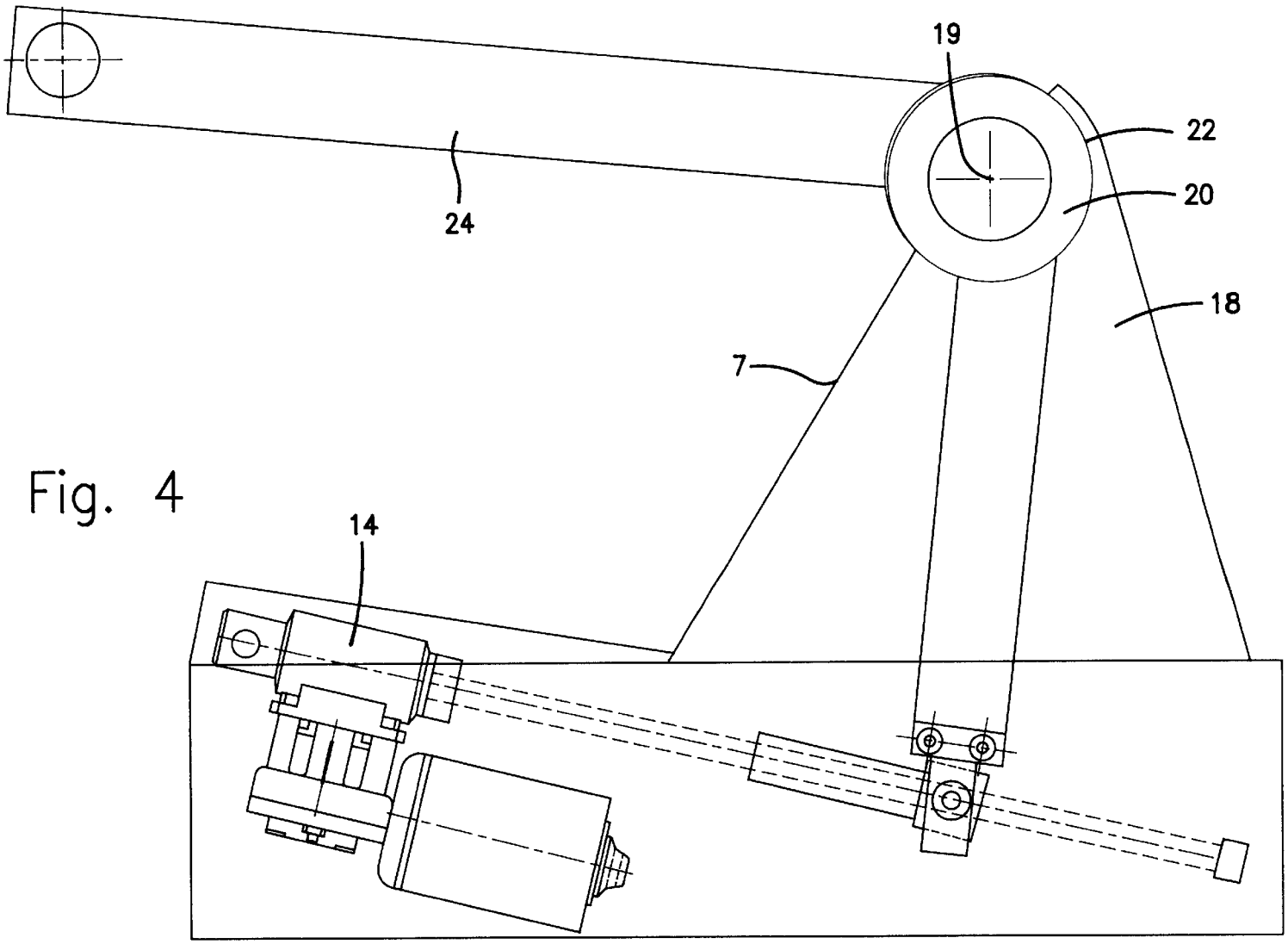
FIG. 4 is a view showing details of the lifting mechanism.

On said box 8 there is a housing 7 containing said lever 18. The interior of said housing is shown in FIG. 4. The lever 18 is pivotally connected in the same pivot point 19, i.e. the bearing 20, as the lifting arm 24. A linear actuator 14 is mounted in the box 8, and connected to the lever 18 in a pivot point in the end thereof opposite the end attached to said bearing 20, such that when the linear actuator 14 is energized, it will act on the lever 18 such that the lever will turn around the pivot point 19, thereby causing a movement of the lifting arm 24.

The yoke 28 comprises a vertical lifting element 29, in the shown embodiment made of a square profile tube. The lifting arm 24 and the parallel rod 26, respectively, are pivotally mounted on the vertical element 29, such that the lifting arm 24 is mounted approximately midway from the upper end of said element, and the parallel rod 26 is mounted at or near the lower end thereof.

The parallel rod 26 is further mounted in a pivot on said housing 7, such that when the linear actuator causes movement of the lifting arm 24, the parallel rod will restrict said vertical element 29 to take a vertical position during the raising and lowering movements.

The end of the lifting arm 24 is carried in a bearing in the lifting yoke 28, as is the parallel rod 26. The lever 18 and the lifting arm 24 form a unit such that when the lifting actuator 14 rotates/pivots the lever 18 in its bearing, also the lifting arm will be rotated/pivoted, thereby lifting the yoke 28 on which a bunk 30 is pivotally mounted. The parallel rod 26 is adapted to maintain/hold the yoke 28 and thereby also the bunk 30 at a constant angle with respect to the horizontal plane during the lifting movement. If the length of the parallel rod 26 is changed by energizing the motor of said linear actuator, the angle of the of the yoke 28 will change thereby changing the angle of the bunk in the longitudinal direction. In this way the bunk regardless of its elevation can assume different selectable inclinations, from a so called drainage position (low head end) to an upright position.

The yoke 28 has a horizontal axis 32, which is parallel to the bunk 30, and extends in the longitudinal direction of the bunk. On said axis 32 a horizontal rod 54 is pivotally mounted.

In the shown embodiment, by means of a linear actuator 34, the bunk may be tilted sideways around the horizontal axis 32. One end of the actuator 34 is pivotally mounted in a portion of said yoke 28, the other end at the linear actuator 34 namely on one of aid arms 52, that is located at the edge of the bunk on the side opposite the side which approaches the bed.

Figure 2:
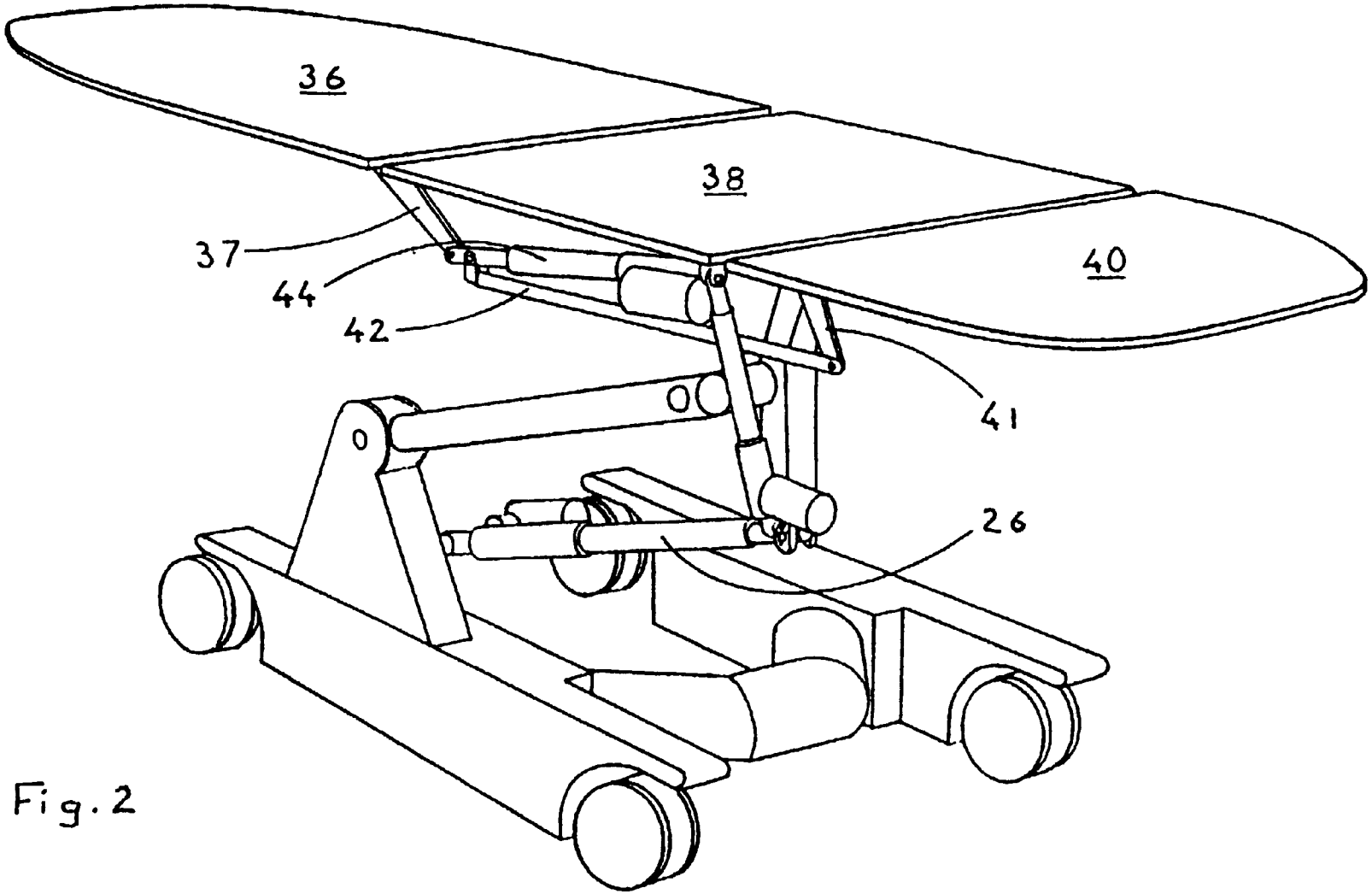
FIG. 2 is a perspective view showing the bunk having a three-part-configuration in a horizontal position.
Figure 3:
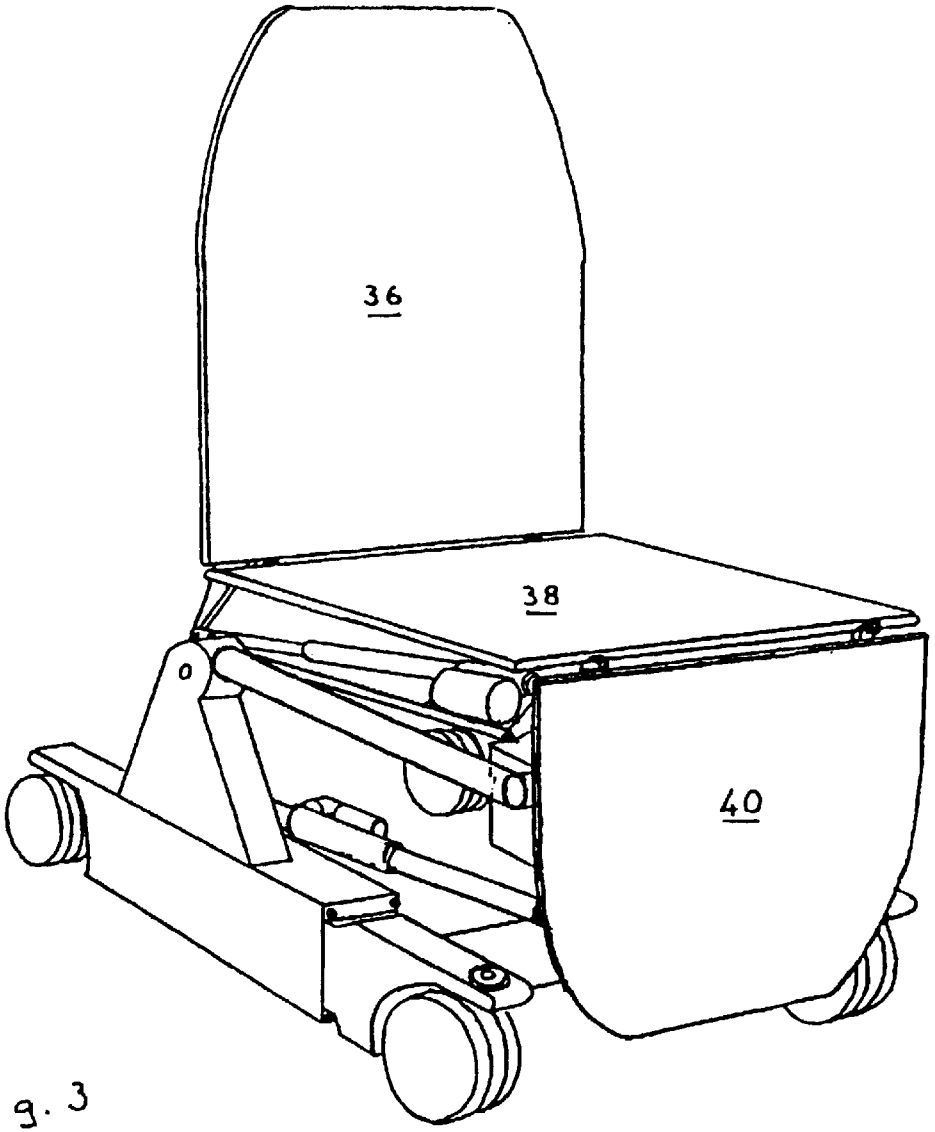
FIG. 3 is the same as FIG. 2 in an upright sitting position.

The bunk 30 itself comprises three sections (see FIG. 2), namely back rest 36, seat 38 and leg rest 40. Back rest 36 and leg rest 40 are pivotally hinged to the seat 38 at opposite sides of the seat. The back rest 36 is connected to the leg rest 40 via a parallel rod 42. The parallel rod 42 is pivotally mounted on back rest and foot rest respectively. To the back rest is also connected a linear actuator 44, by means of which the angle of the back rest can be changed from a horizontal bed position to an upright seated position (see FIG. 3). Thereby the leg rest 40 moves in parallel by virtue of the parallel rod 42 connecting back rest 36 and leg rest 40.

The seat may comprise an opening covered with a removable lid, for toilet purposes (not shown).

The parallel rod 42 is connected to back rest 36 and foot rest 40 respectively via cantilever console members 37 and 41, mounted on the back rest 36 and leg rest 40 respectively. Said consoles 37, 41 are preferably mounted on the respective part, adjacent the edges where respective part pivotally connects to the seat 38.

The linear actuator 44 is pivotally mounted in the console member 37 belonging to the back rest 36, and its other end is mounted at a fixed point on the seat 38.

With reference to FIGS. 6–9 a preferred embodiment comprising the mechanism for performing the special tilting function of the bunk will be described.

Figure 6:
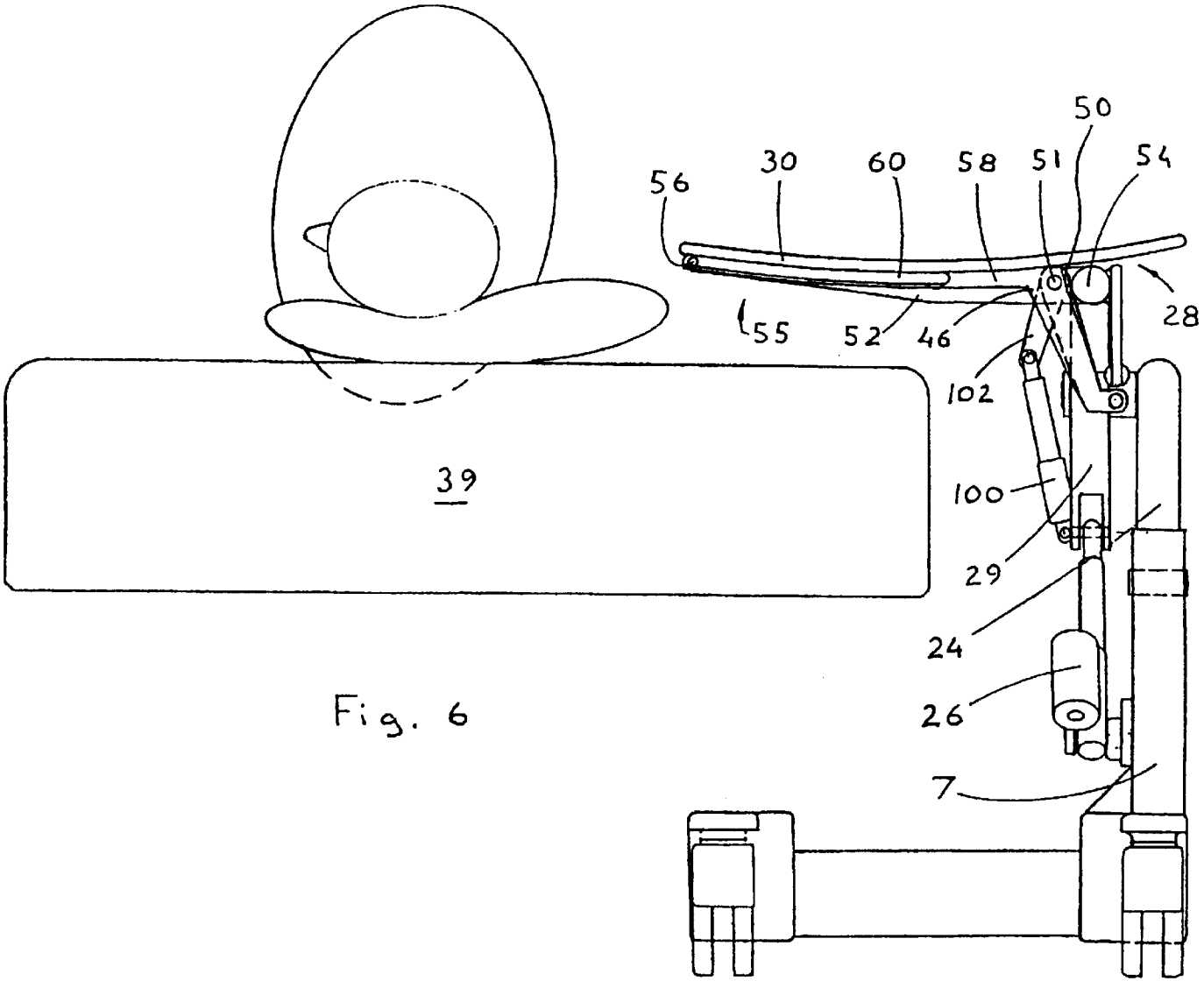
FIGS. 6–9 show the various positions during a transfer operation.

In FIG. 6 the roll bunk of the invention is shown to have been positioned alongside a bed 39 onto which a patient is to be placed, or from which a patient is to be picked up.

The bunk 30 is provided with a pair of cantilever console members 46 (only one visible in FIG. 6). These consoles 46 are at their respective free ends 48 pivotally connected to a linkage 50 which in its turn at its opposite end is pivotally connected to a respective arm 52 of the yoke 28 at a pivot point 51. Said arms 52 extend underneath the bunk 30 and are connected to a rod member 54 extending parallel to the bunk. The arms 52 and rod 54 are all integral parts of the yoke 28. At the tip 55 of each of said arms 52 there is a pin 56 extending from said arm in the longitudinal direction of the bunk.

On the bottom side of the bunk 30 there are two ridges 58 (only one visible in FIG. 6), forming an integral part with said consoles 46, and extending across the bunk in the transverse direction. In each ridge 58 there is a groove or recess 60 mating with said pins 56, provided on the arms 52.

A rotational actuator (see FIG. 8) provided with a gear 53 on its outgoing axis is mounted such as to engage with a toothed circular element 55 pivotally mounted and integral with linkage 50, to cause the linkage 50 to rotate around the pivot point 51, thereby causing the bunk to move as will be described below in connection with the Example. In an alternative embodiment the rotational movement may be obtained by a linear actuator 100 (see FIG. 6). In this embodiment there is provided an additional arm 102 mounted in the same pivot point 51 as and integral with the arm 50. The actuator 100 is pivotally connected to the vertical lifting member 29, at the lower end thereof, and in a pivot point at the free end of said arm 102.

Figure 7:
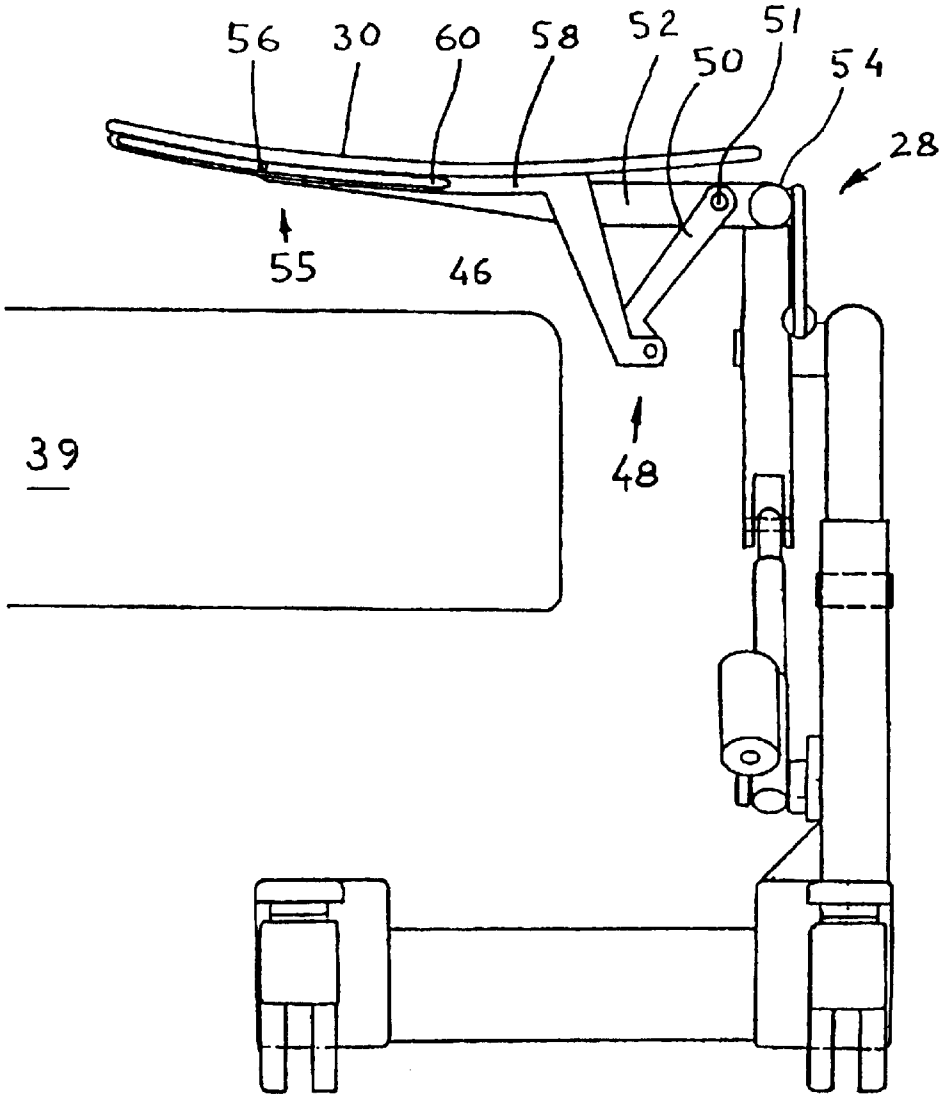
Figure 9:
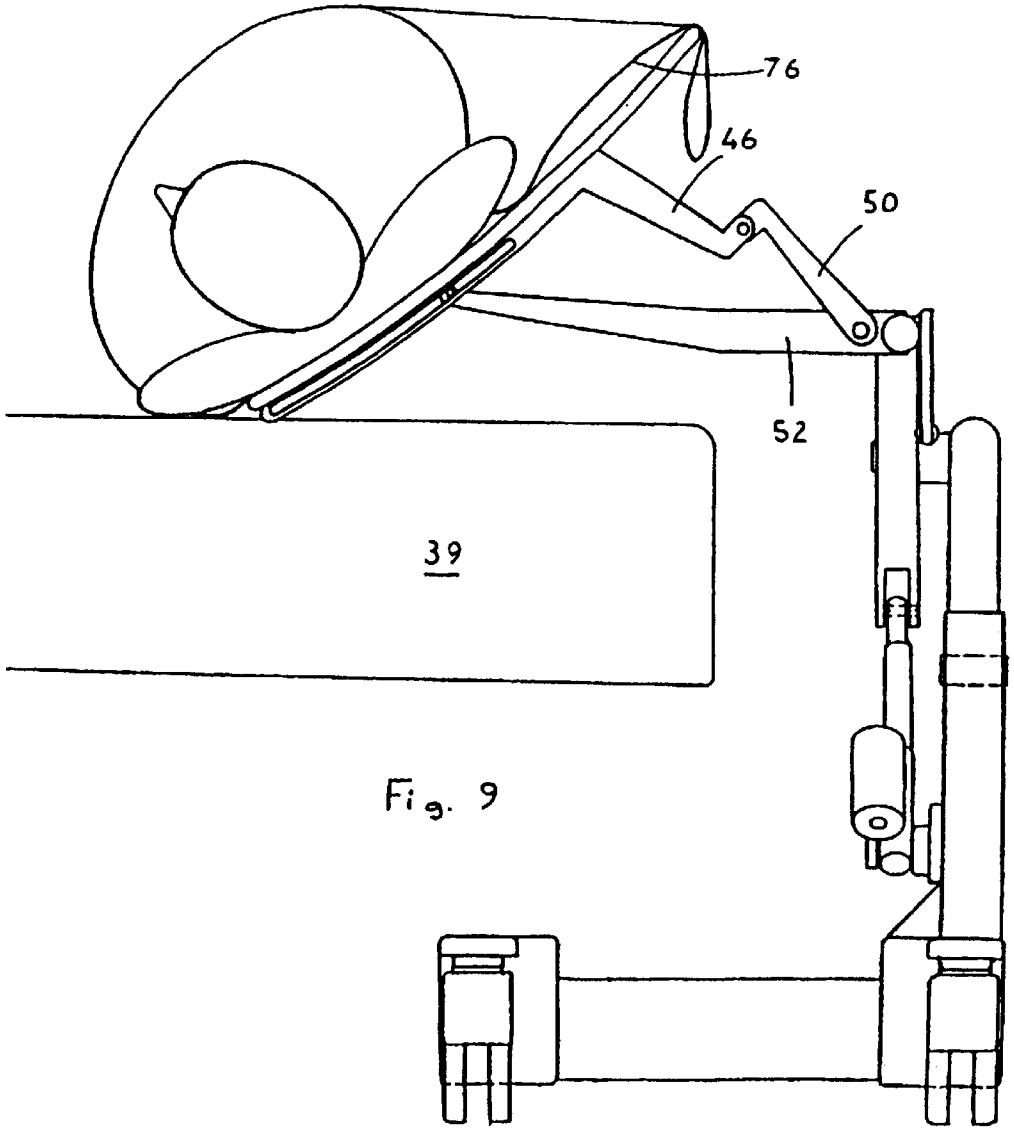

The rotational actuator and the linear actuator 100 are optional choises, and other means of achieving the tilting of the bunk are regarded as being within the scope of the invention. In FIGS. 7 and 9 no actuators are shown in order to make the figures clearer.

In order to facilitate the performing of the method of moving a patient, there is also within the scope of the invention provided a drag sheet having an inventive design.

Figure 5A:
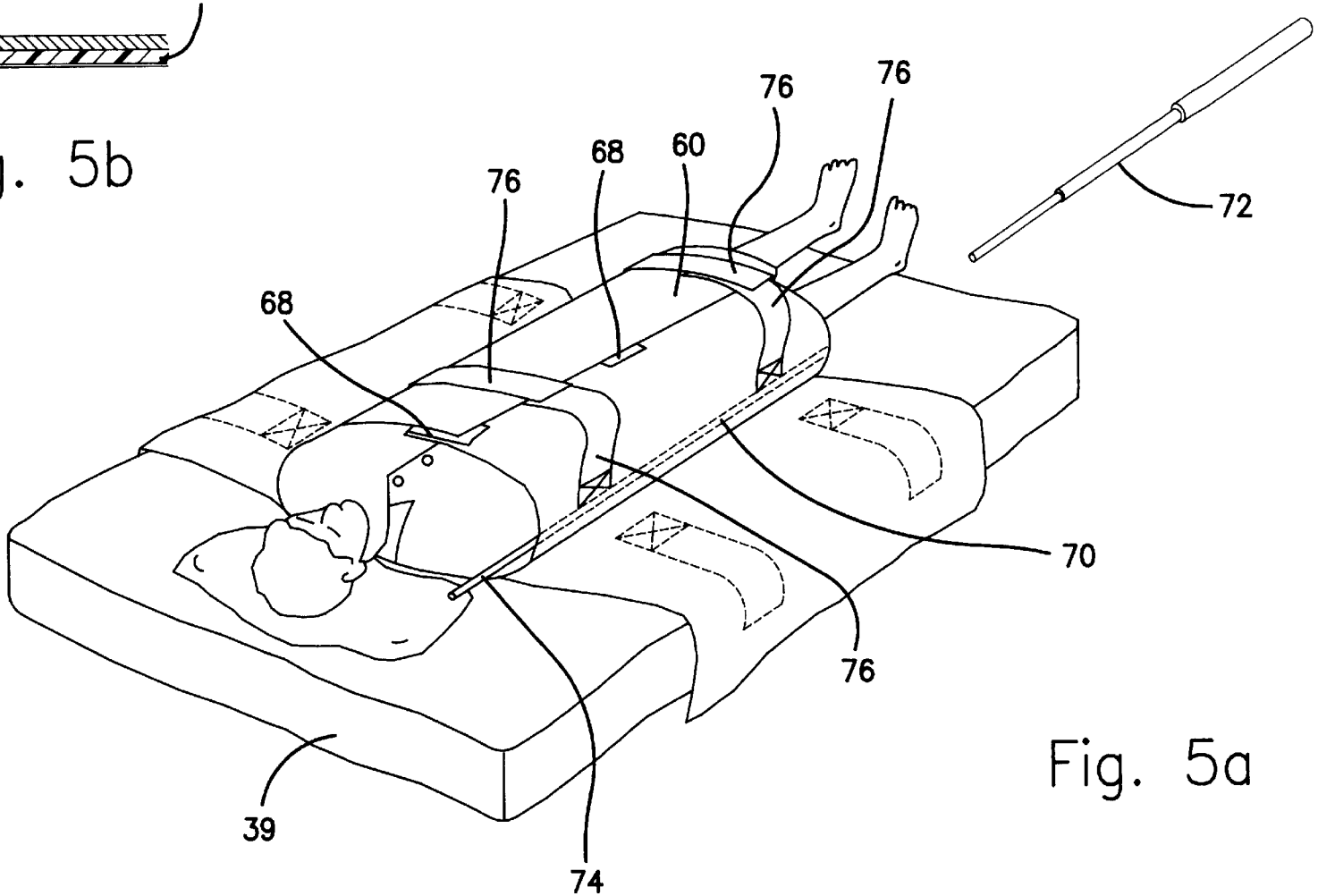
FIG. 5*a* illustrates the drag sheet of the invention.

This drag sheet is shown in FIG. 5*a* and generally designated 60. It is shown both wrapped around a patient, and with shadow lines in its position stretched on and tucked around the bed.

Figure 5B:
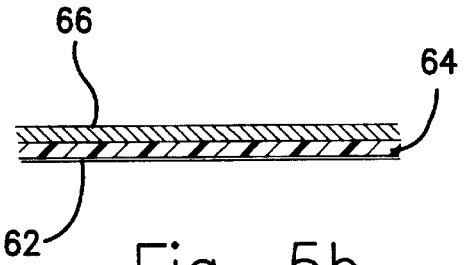
FIG. 5*b* illustrates layers of materials used in making the drag sheet.

The drag sheet is built up of two to three layers, 62, 64, 66 (FIG. 5*b*). One layer 64 comprises a sheet of a type of material that is liquid impermeable, but still has the ability to "breathe". It is a material commonly used in rain garments, especially for sports and leisure use. A commercially available brand is GORETEX®. Over the sheet of e.g. GORETEX there is provided a layer 66 of ordinary white bed sheet, preferably of cotton or the like. For incontinent patients the upper layer could be of a moisture absorbing material.

In a particularly preferred embodiment there is provided a bottom layer 62 of a material having low friction, such as the same material as is used in the glide mats mentioned above. An example of a suitable material is nylon, although other synthetic materials having low friction properties are usable. Such a low friction layer will facilitate the use of the drag sheet considerably when it comes to moving a patient sideways.

The drag sheet is in one embodiment long enough to cover the patient excluding head and lower part of the legs. However, it is equally conceivable to let it extend over the entire length of a patient or any length therebetween. The width of the sheet 60 is about 20–50 cm wider than a bed, in order that the sheet may be tucked around the mattress when not used as a drag sheet.

The provision of the GORETEX layer will have several benefits:

First, it will effectively stop mites from penetrating into the mattress, which is a major cause of allergic responses.

Secondly, because it breathes, it will also prevent the patients skin from becoming exceedingly moist, one of the causes of bed or pressure sores.

Also, the GORETEX layer will actually make the top layer less prone to crumble up, a cause of inconvenience for patients spending all day in bed.

On the long sides of the drag sheet 60 there may be provided fastening means 68 of the VELCRO® type. These fastening means are used to secure the drag sheet around the patient when it is to be used for its transport aid purpose (to be described). Other means are of course equally conceivable, e.g. hooks and mating holes, zippers or simply strings for tying the edges together.

The drag sheet may be provided with channels 70 (shown with shadow lines in FIG. 5*a*) in the longitudinal direction. In these channels stiffening means 72 may be inserted when required, such as when it is important to fix the patient in position. These stiffening means may e.g. be made of aluminum tubes, arranged in a telescoping fashion, in order that they may be adapted to various lengths of the drag sheet.

There may also be provided means 74 for fastening the pillow on which the patient's head rests to the drag sheet, such as it may be moved together with the sheet. Of course it is possible that the pillow rests on the sheet, if the latter extends all the length of the patient. The fastening means may be VELCRO type means, snap means or the like.

There are also preferably provided a number of straps 76, in the shown embodiment four straps, pairwise attachable, e.g. by means of VELCRO® type fasteners, to each other, one pair at the head end, the other at the foot end of the drag sheet. These straps are used for providing means to conveniently hold the sheet firmly during the transfer of the patient, which will be more clearly understood upon reading the description in the EXAMPLE below.

Use of the tiltable coach and the drag sheet according to a preferred embodiment of the invention will now be described by way of an exemplifying procedure according to the invention, wherein a patient is moved from the bed, therapy is carried out, and the patient is moved back onto the coach again.

EXAMPLE

In the process of moving a patient from a bed to the bunk of the invention, the drag sheet is pulled out from under the mattress and wrapped around the patient, the long sides of the sheet being attached to each other by means of the VELCRO type fastening means. By pulling the straps on the drag sheet the patient is turned over so as to be lying on one side.

Then, from the position shown in FIG. 6, the rotational actuator is activated causing the linkage 50 to move clockwise, thereby initially causing a sliding movement of the bunk 30 to the position shown in FIG. 7. Up to this point the bunk 30 has been kept essentially horizontal, and there has only been a sideways movement to project the bunk further in over the bed.

Figure 8:
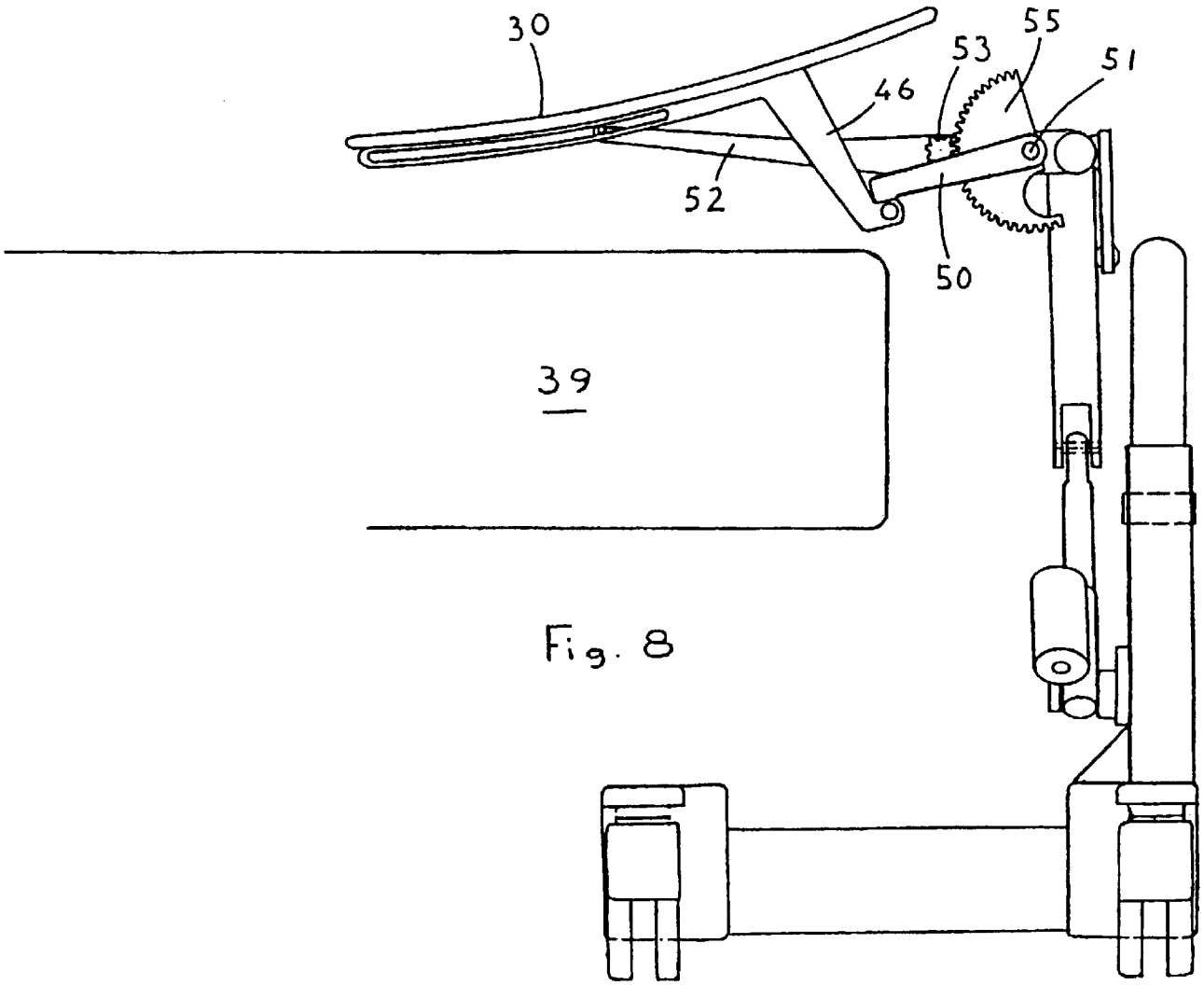

After the position of FIG. 7 has been reached, the sideways movement will continue, but at the same time the horizontal linear vector of the linkage movement will be shorter, and thus the rate of sideways movement will decrease. Also, because of the console 46 being rigidly connected to, or integral with the ridges 58, the continued movement of the linkage in the upwards direction will cause that side of the bunk remote of the bed to raise, and thus the bunk will begin to tilt towards the bed, as shown in FIG. 8.

Continued movement of the linkage 50 will cause the bunk to tilt further until the desired position according to FIG. 9 has been reached, where also the side of the bunk closest to the patient now will have been lowered such as to contact the bed, and also will have been placed slightly underneath the patient lying in the bed.

From this position it will be possible to carefully place the patient by pulling the drag sheet straps over the edge of the bunk, and firmly keep it there, in order that enough of the body weight is placed on the bunk for the remaining operation. Thus, when the patient has been partly placed on the now tilted bunk, the direction of rotation of said rotational actuator is reversed. Thereby the bunk will be tilted back to a horizontal position, now with the patient placed on the bunk, and then withdrawn back to the position shown in FIG. 6.

When the patient has been properly located on the surface of the bunk, the necessary treatment (i.e. sitting or standing therapy as mentioned earlier) can be performed directly, that is in the ward and without need to move the patient to other locations in the hospital.

After treatment and from the position shown in FIG. 6, with a patient now lying down on the roll bunk, the rotational actuator is activated causing the linkage 50 to move clockwise, thereby initially causing a sliding movement of the bunk 30 to the position shown in FIG. 7. The entire procedure is repeated in the other direction, and the patient is safely placed in the middle of the bed.

One of the great advantages of the invention is the fact that one is able to place the patient in the middle of the bed without needing to drag him or push him there.

Previously one has always been forced to either push the patient onto the bed, which is difficult if it is a heavy patient, or one has had to bend over the bed for pulling. The bed being relatively wide, inevitably renders the working position very unsuitable from an ergonomic point of view.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A roll coach for moving patients to and from a hospital bed, comprising:

a) a frame (4; 6, 8)

b) a movable bunk (30) mounted on said frame (4; 6, 8);

c) a lifting mechanism (14, 18, 20, 22, 24) connecting said bunk (30) with said frame and operable to move said bunk in a vertical direction;

d) means (50) for causing a sideways movement of said bunk (30), while keeping said bunk (30) essentially horizontal;

e) a tilting mechanism (28, 32, 34) operable to tilt said bunk (30) to bring the side of said bunk in contact with the bed essentially in the middle of the bed, while continuing said sideways movement of said bunk, but such that the rate of said sideways movement will decrease; and f) means for reversing (100; 55) movements caused by aid means defined in c)–e).

2. The roll coach of claim 1, wherein said lifting mechanism is connected to the frame on one side thereof, such that that the frame is insertable under a hospital bed, whereby said bunk (30) is moveable sideways in over said bed.

3. The roll coach of claim 2, wherein said lifting mechanism comprises a linear actuator (14) provided in the frame and pivotally connected to a lever (18), pivotally mounted in a bearing (20), and a lifting arm (24) rigidly connected to said lever (18) and moveable together with said lever in said bearing (20), a vertical lifting member (29) to which said lifting arm (24) is connected, such that when said linear actuator (14) is displaced said lifting arm (24) moves, thereby causing movement of said vertical lifting member (29).

4. The roll coach of claim 2, wherein said tilting mechanism (28, 32, 34) comprises a yoke (28) on which said bunk (30) rests, having two supporting arms (52) attached to a longitudinal rod member (54), pivotally mounted on said lifting member (29).

5. The roll coach of claim 2, wherein said bunk (30) is tiltable in the longitudinal direction while kept in a plane position, such that the patient will retain his stretched out position during tilting.

6. The roll coach of claim 1, wherein said lifting mechanism comprises a linear actuator (14) provided in the frame and pivotally connected to a lever (18), pivotally mounted in a bearing (20), and a lifting arm (24) rigidly connected to said lever (18) and moveable together with said lever in said bearing (20), a vertical lifting member (29) to which said lifting arm (24) is connected, such that when said linear actuator (14) is displaced said lifting arm (24) moves, thereby causing movement of said vertical lifting member (29).

7. The roll coach of claim 6, wherein said tilting mechanism (28, 32, 34) comprises a yoke (28) on which said bunk (30) rests, having two supporting arms (52) attached to a longitudinal rod member (54), pivotally mounted on said lifting member (29).

8. The roll coach of claim 1, wherein said tilting mechanism (28, 32, 34) comprises a yoke (28) on which said bunk (30) rests, having two supporting arms (52) attached to a longitudinal rod member (54), pivotally mounted on said lifting member (29).

9. The roll coach of claim 8, further comprising ridges (58) attached to the underside of the bunk (30) in the transverse direction, said ridges being provided with a recess (60) each, for receiving a respective guide pin (56) mounted at the tip of each of said supporting arms (52), and a console (46) integral with each ridge and extending essentially downwards, said consoles being pivotally connected at their free ends to one end of a linkage (50), said linkage being rotatable at a pivot point (51) at the other end of said linkage.

10. The roll coach of claim 9, wherein said bunk (30) comprises three portions, a back rest (36), a seat (38), and a leg rest (40), said back rest (36) and leg rest (40) being pivotally connected to the seat (38), and connected with each other by parallel linkage means such that they are movable in ensemble to an upright position.

11. The roll coach of claim 1, wherein said bunk (30) is tiltable in the longitudinal direction while kept in a plane position, such that the patient will retain his stretched out position during tilting.

12. The roll coach of claim 1, wherein said bunk (30) is tiltable in the longitudinal direction while kept in a sitting mode, such that the patient will retain his sitting position during tilting.

13. A method of moving a patient from a moveable bunk and into a hospital bed, comprising the following steps:

a) positioning a tiltable bunk on which a patient is lying down, at the side of a bed into which the patient is to be transferred;

b) moving said bunk sideways such that it extends further in over the bed, while maintaining a horizontal position;

c) tilting the bunk when it has reached a position near the middle of the bed, during continued sideways movement, until it contacts the bed surface essentially at the middle of the bed;

d) letting the patient slide off the bunk onto the bed; and e) removing the bunk from the bed.

14. A method of moving a patient from a hospital bed and onto a moveable bunk, comprising the following steps:

a) placing the patient in a side position;

b) positioning a tiltable bunk, at the side of the bed to which the patient turns his back;

c) moving said bunk sideways, such as it extends further in over the bed;

d) initiating tilting of the bunk when it has reached a position near the middle of the bed, during continued sideways movement, until it contacts the bed surface at the middle of the bed, in the nook/corner formed by the back of the patient and the bed surface;

e) leaning the patient against the bunk;

f) fixing the position of the patient relative to the bunk;

g) reversing the tilting movement of the bunk such that the patient will be lifted from the bed surface until the bunk reaches the horizontal; and h) removing the bunk from the bed.

15. The method of claim 14, comprising providing a drag sheet in the bed, said drag sheet being wrappable around the patient, in order to achieve the fixed position of step f).

* * * * *